US005292059A

United States Patent [19]

Oliff

[11] Patent Number: 5,292,059

[45] Date of Patent: Mar. 8, 1994

[54] TUBULAR CARTON HAVING TRIANGULAR CORNER PANELS

[75] Inventor: James R. Oliff, Austell, Ga.

[73] Assignee: The Mead Corporation, Dayton, Ohio

[21] Appl. No.: 33,481

[22] Filed: Mar. 18, 1993

[51] Int. Cl.[5] ..... B65D 5/08

[52] U.S. Cl. ..... 229/137; 229/40; 229/186

[58] Field of Search ..... 229/40, 137, 138, 186; 206/427

[56] References Cited

U.S. PATENT DOCUMENTS

| | | | |
|---|---|---|---|
| 3,688,972 | 9/1972 | Mahon | 229/51 TS |
| 3,757,991 | 9/1973 | Stout | 220/113 |
| 4,022,372 | 5/1977 | Graser | 229/40 |
| 4,101,069 | 7/1978 | Wood | 729/40 |
| 4,216,861 | 8/1980 | Oliff | 229/40 |
| 4,577,799 | 3/1986 | Oliff | 229/40 |
| 4,679,726 | 7/1987 | Oliff | 229/138 |
| 4,732,316 | 3/1988 | Oliff et al. | 229/40 |
| 4,747,487 | 5/1988 | Wood | 206/429 |
| 4,925,019 | 5/1990 | Ganz et al. | 229/40 |
| 5,000,313 | 3/1991 | Oliff | 229/40 |
| 5,060,792 | 10/1991 | Oliff | 229/40 |
| 5,131,588 | 7/1992 | Oliff | 229/40 |
| 5,156,269 | 10/1992 | Bakx | 206/427 |
| 5,195,676 | 3/1993 | LeBras | 229/40 |

FOREIGN PATENT DOCUMENTS 178702 4/1986 European Pat. Off. ..... 229/137

*Primary Examiner*—Gary E. Elkins

*Attorney, Agent, or Firm*—Tsugihiko Suzuki

[57] ABSTRACT

A carton comprises top and bottom walls connected together by first and second spaced side walls to form a tubular structure. A set of end closure elements is disposed at each end of the tubular structure to close that end. Each set of end closure elements comprises major and minor end flaps and a web panel. The minor end flap is joined to one of the top and bottom walls and is disposed at a right angle with respect to the axis of the tubular structure. The major end flap is joined to the first side wall and is disposed in overlapping relationship with the minor end flap. The web panel interconnects the major and minor end flaps and is tucked in between the major and minor end flaps. The corner of the first side wall that is defined between the major end flap and the one wall to which the minor flap is joined is bevelled and is severed from the adjacent portions of the carton. The junction between the minor end flap and the one wall comprises a single fold line extending from the second side wall toward the first side wall. The single fold line bifurcates into two branch fold lines at an intermediate point between the first and second side panels. These branch fold lines extend from the intermediate point to the bevelled corner of the first side wall so that a triangular corner panel is defined between the branch fold lines.

5 Claims, 7 Drawing Sheets

TUBULAR CARTON HAVING TRIANGULAR CORNER PANELS

BACKGROUND OF THE INVENTION

This invention relates to a tubular carton having good structural integrity as well as increased end wall flatness which are accomplished through the utilization of an improved carton corner structure.

It is known to form carton corners with so called bevelled corner panels that are in direct contact with the associated packaged articles. A conventional carton with such corner panels is disclosed for example in U.S. Pat. No. 4,216,861 issued Aug. 12, 1980 and owned by the assignee of this invention. These corner panels prevent undesirable crushing of the carton corners during transportation or storage and also increase tightness or compactness of the carton. The corner panels, however, reduce the proportion of the flat surface in the carton end walls, the flat surface being generally perpendicular to the axis of the tubular structure. It is often desirable that carton end walls be as flat as possible to be useful as, for example, billboard space.

What is needed, therefore, is a carton having an end wall of increased flatness that still maintains adequate structural integrity.

SUMMARY OF THE INVENTION

According to the present invention, the term "flatness" refers to the degree of smoothness of the carton end walls and to the proportion of the flat surface in the carton end walls, which flat surface is generally perpendicular to the axis of the tubular structure. The term "integrity" refers to tightness/compactness and ability to prevent crushing of the carton corners.

The present invention in one form provides a carton comprising top and bottom walls connected together by first and second spaced side walls to form a tubular structure. End closure means is disposed at each end of the tubular structure to close that end. The end closure means comprises major and minor end flaps and a web panel. The minor end flap is foldably joined to one of the top and bottom walls and is disposed at a right angle with respect to the axis of the tubular structure. The major end flap is foldably joined to the first side wall and is disposed in overlapping relationship with the minor end flap. The web panel foldably interconnects the major and minor end flaps and is tucked in between the major and minor end flaps. The corner of the first side wall that is defined between the major end flap and the one wall to which the minor flap is joined is bevelled and is severed from the adjacent portions of the carton. The junction between the minor end flap and the one wall comprises a single fold line extending from the second side wall toward the first side wall. The single fold line bifurcates into two branch fold lines at an intermediate point between the first and second side panels. These branch fold lines extend from the intermediate point to the bevelled corner of the first side wall so that a triangular corner panel is defined between the branch fold lines.

According to the invention, the triangular corner panel is positioned near the first side wall and between the one wall and the minor end flap. The corner panel is in direct contact with the associated packaged articles, i.e., the contents of the carton, and therefore contributes to tightness of the carton and to prevention of undesirable crushing of the respective corner of the carton.

However, along the single fold line, the one wall is joined directly to the minor end flap without the corner panel interposed therebetween. This, in other words, means that the portion of the end closure means near the second side wall extends all the way between the top and bottom walls and provides a flat surface therebetween that is considerably wider than the flat surface that could be available if the corner panel extended entirely along the end edge of the one wall.

Although the web panels that are tucked in between the major and minor end flaps could impair flatness (i.e., the degree of smoothness) of the carton end wall by raising the major end flap from the surface of the minor end flap, the carton of the present invention eliminates such a web panel from at least the corner between the minor end flap and a second major end flap which may be joined to the second side wall. This arrangement can reduce snagging of the second major end flap and subsequent destructive damage to the carton.

The present invention in another form provides a carton blank which comprises first and second walls, major and minor end flaps, and a web panel. The second wall is foldably joined to the side edge of the first wall. The major end flap is foldably joined to the end of the first wall. The minor end flap is foldably joined to the end of the second wall adjacent to the major end flap. The web panel foldably interconnects the major and minor end flaps. The corner of the first wall defined between the second wall and the major end flap is bevelled and is severed by an aperture from the adjacent portions of the blank. The junction between the minor end flap and the second wall comprises a single fold line extending from the side edge of the second wall remote from the first wall toward the aperture. The single fold line bifurcates into two branch fold lines at an intermediate point between the aperture and the side edge of said second wall. The branch fold lines extend from the intermediate point to the aperture so as to define a triangular corner panel foldably joined to the second wall and to the minor end flap.

Accordingly, it is an object of the present invention to provide a carton which has increased end wall flatness and which still maintains good structural integrity.

Other objects and advantages of the present invention will be apparent from the following description, the accompanying drawings and the appended claims.

DETAILED DESCRIPTION OF THE PREFERRED EMBODIMENT

Figure 1:
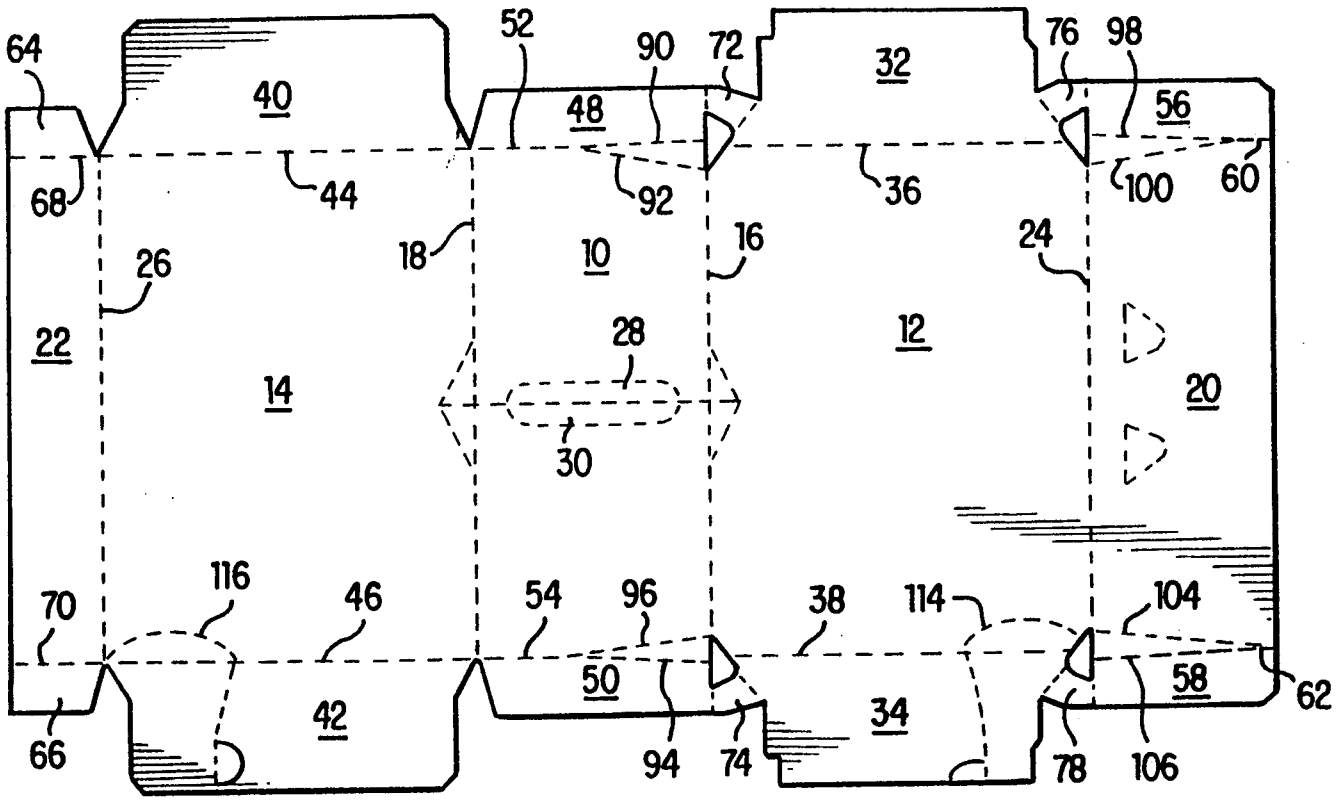
FIG. 1 is a plan view of a blank from which the carton according to the present invention is formed.

A carton according to the present invention is shown in blank form in FIG. 1 wherein reference numeral 10 designates a top wall of the carton. Side walls 12 and 14 are foldably joined to the side edges of the top wall 10 along fold lines 16 and 18. Bottom lap panels 20 and 22 are foldably joined respectively to the side walls 12 and 14 along fold lines 24 and 26. A carrying handle is provided for the carton and includes a pair of flaps 28 and 30 that close a finger receiving slot formed in the top wall 10. The details of such a carrying handle is disclosed for example in U.S. Pat. No. 4,558,816 issued Dec. 17, 1985 which is hereby incorporated by reference.

Major end flaps 32 and 34 are foldably joined to the end edges of side wall 12 along fold lines 36 and 38 respectively. In like fashion, major end flaps 40 and 42 are foldably joined to the end edges of the side wall 14 along fold lines 44 and 46 respectively.

Minor end flaps 48 and 50 are foldably joined respectively to the end edges of the top wall 10 along fold lines 52 and 54. Likewise, partial minor end flaps 56 and 58 are foldably joined respectively to the end edges of the bottom lap panel 20 along fold lines 60 and 62. Another pair of partial minor end flaps 64 and 66 are foldably joined to the end edges of the bottom lap panel 22 along fold lines 68 and 70 respectively.

Figure 2:
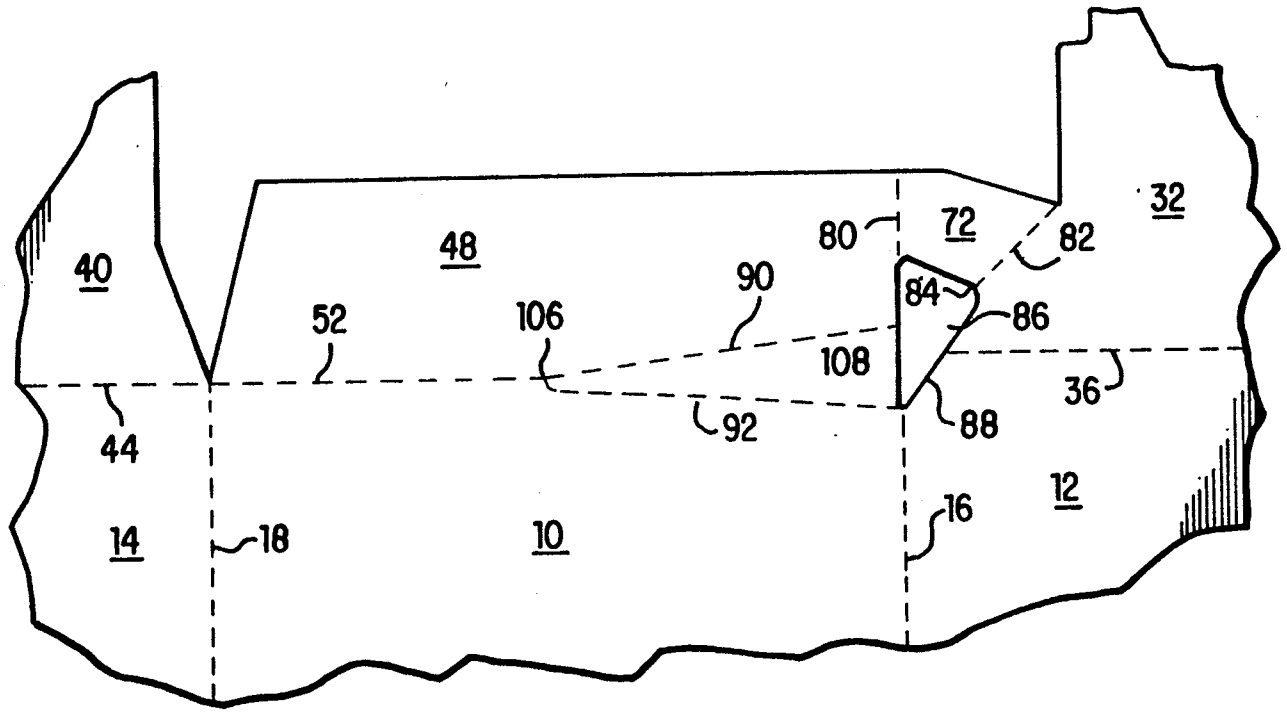
FIG. 2 is an enlarged fragmentary view of a portion of the blank in FIG. 1.

Means to interconnect the end flaps 32, 34, 48, 50, 56 and 58 is provided in the form of web panels 72, 74, 76 and 78. Since all of the web structures 72, 74, 76 and 78 are virtually identical, only the specific features of the web panel 72 will be described here in detail. With particular reference to FIG. 2, the web panel 72 is foldably joined to the minor end flap 48 along a fold line 80. The other end of the web panel 72 is foldably joined to the major end flap 32 along a fold line 82. The inner end 84 of the fold line 82 is spaced from fold line 36 by an aperture 86 formed in the blank at the corner 88 of the side wall 12 adjacent to the web panel 72. This corner 88 of the side wall 12 is bevelled and is severed from the adjacent portions by the aperture 86.

According to a feature of this invention, each of the fold lines 52 and 54 is a single fold line at the left end thereof as viewed in FIG. 1 but is bifurcated as indicated at 90, 92, 94 and 96 at the right end thereof as viewed in the same drawing. Likewise, each of the fold lines 60 and 62 is a single fold line at the right end thereof as viewed in FIG. 1 but is bifurcated as indicated at 98, 100, 104 and 106 at the left end thereof as viewed in the same drawing. Since all of the fold lines 52, 54, 60 and 62 are virtually similar, only the fold line 52 and the portions associated therewith will be described in detail hereinafter.

As best illustrated in FIG. 2, the single fold line portion of the fold line 52 is generally aligned with the fold line 36 and extends from the corner of the side wall 14 between fold lines 18 and 44 toward the aperture 86. The single fold line terminates at an intermediate point 106 between the fold line 18 and the aperture 86. The branch fold lines 90 and 92 extend from the intermediate point 106 to the aperture 86. The fold line 90 is offset outwardly of fold line 36 whereas the fold line 92 is offset inwardly of fold line 36. In other words, the fold lines 90 and 92 diverge from each other toward the aperture 86. As a result, a triangular corner panel 108 is defined between the branch fold lines 90 and 92 which corner panel 108 is foldably joined to the top wall 10 and to the minor end flap 48. The above mentioned offset relationship between the fold lines accounts for the angular disposition of the triangular corner panel 108 when the carton is set up.

It is preferred that the fold lines 90 and 92 form as acute an angle as possible to facilitate and to better control folding of the minor end flap 48 to a square position with respect to the top wall 10. However, it is also preferred that the corner panel 108 be as small in length (H) as possible to minimize the proportion of uneven portion in the carton end walls. In a preferred embodiment, the acute corner of the triangular corner panel 108 is rounded as best shown in FIG. 2 to have a compromise between a proper length (H) of the panel 108 and an appropriate acute angle between the fold lines 90 and 92.

To complete the basic elements of the carton, opening means are defined by severance lines 114 and 116 as shown in FIG. 1. The severance line 114 is formed in the main end flaps 34 and in the side wall 12 whereas the severance line 116 is formed in the main end flap 42 and the side wall 14.

Figure 3:
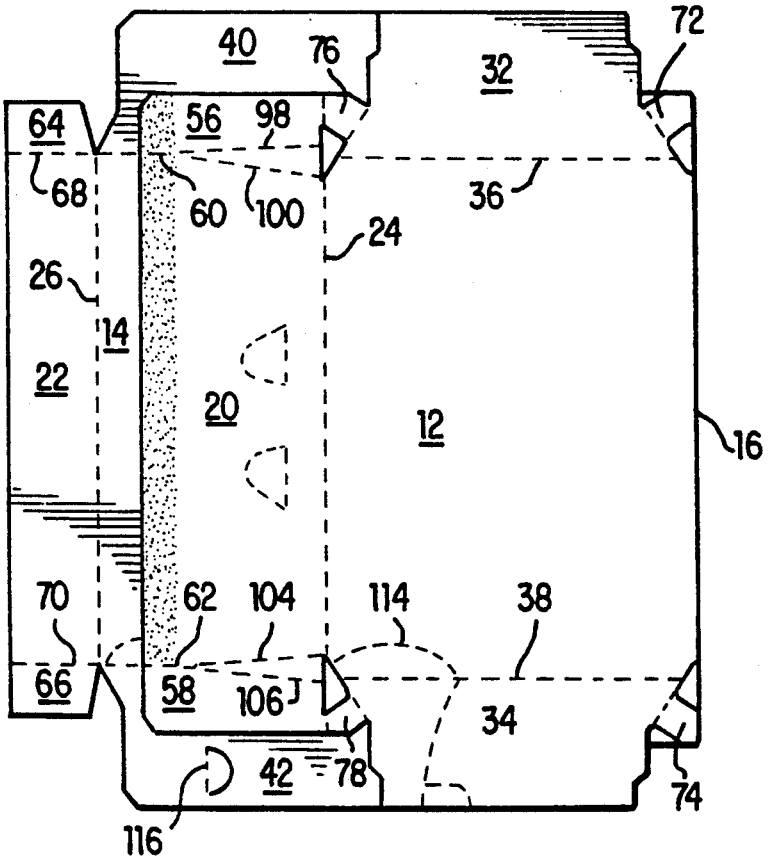
FIGS. 3 and 4 depict intermediate stages through which the blank in FIG. 1 is glued and manipulated in order to form the open ended tubular carton shown in FIG. 5.
Figure 4:
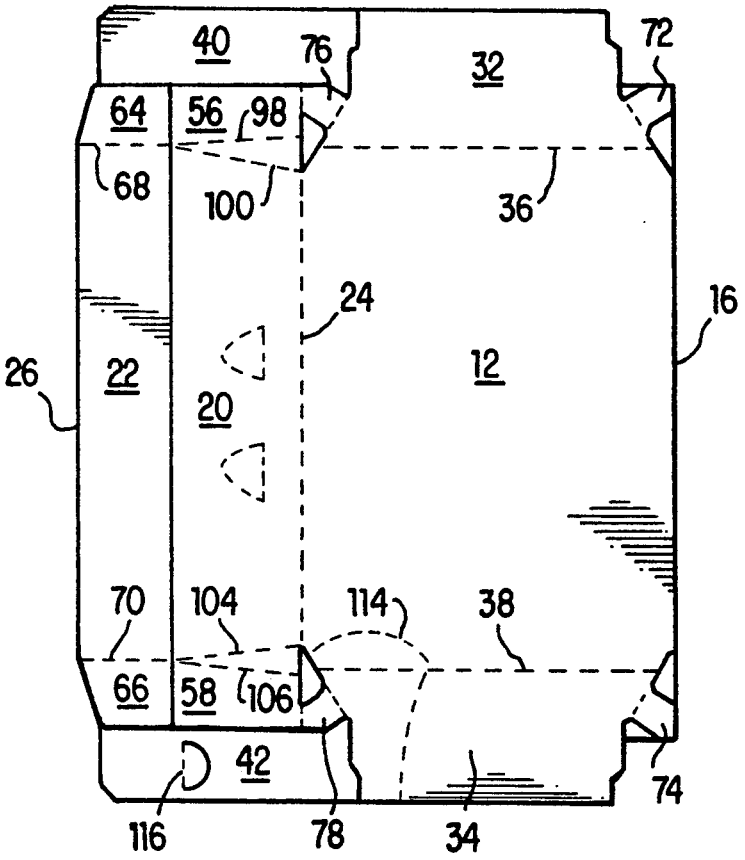

In order to form the carton from the blank, first the elements of the blank to the right of the fold line 16, as viewed in FIG. 1, are elevated and folded to the left along the fold line 16 into the position shown in FIG. 3. Glue is then applied to the blank as indicated by the stippling in FIG. 3. Following this, the bottom lap panel 22 is elevated and folded to the right along the fold line 26 to secure the edges of the bottom lap panels 20 and 22 together and to occupy the position shown in FIG. 4 which represents the completed carton in a collapsed condition.

Figure 5:
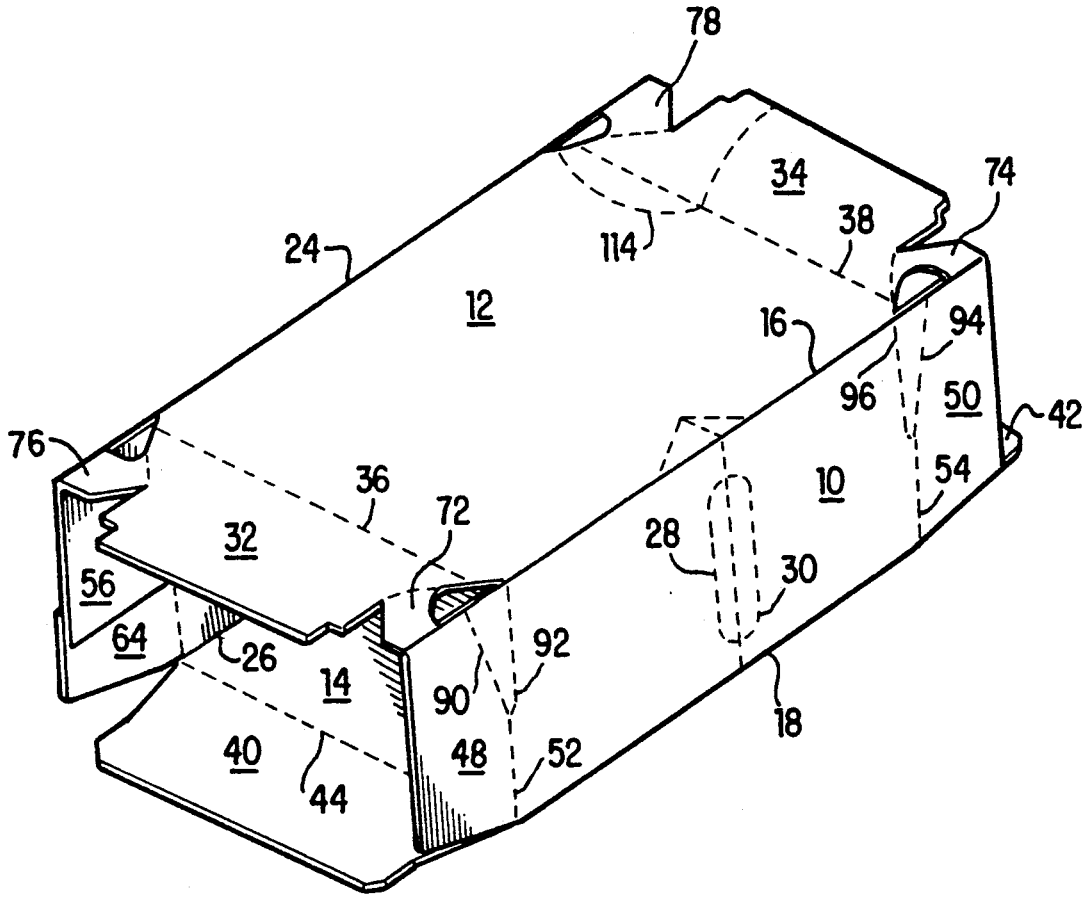
FIG. 5 is a perspective view of the carton in the form wherein the opposite ends of the carton are open.

In order to complete the formation of the carton, the side walls 12 and 14 are separated and positioned perpendicular to the top wall 10 and the bottom lap panels 20 and 22. The carton then appears as shown in FIG. 5.

Figure 6:
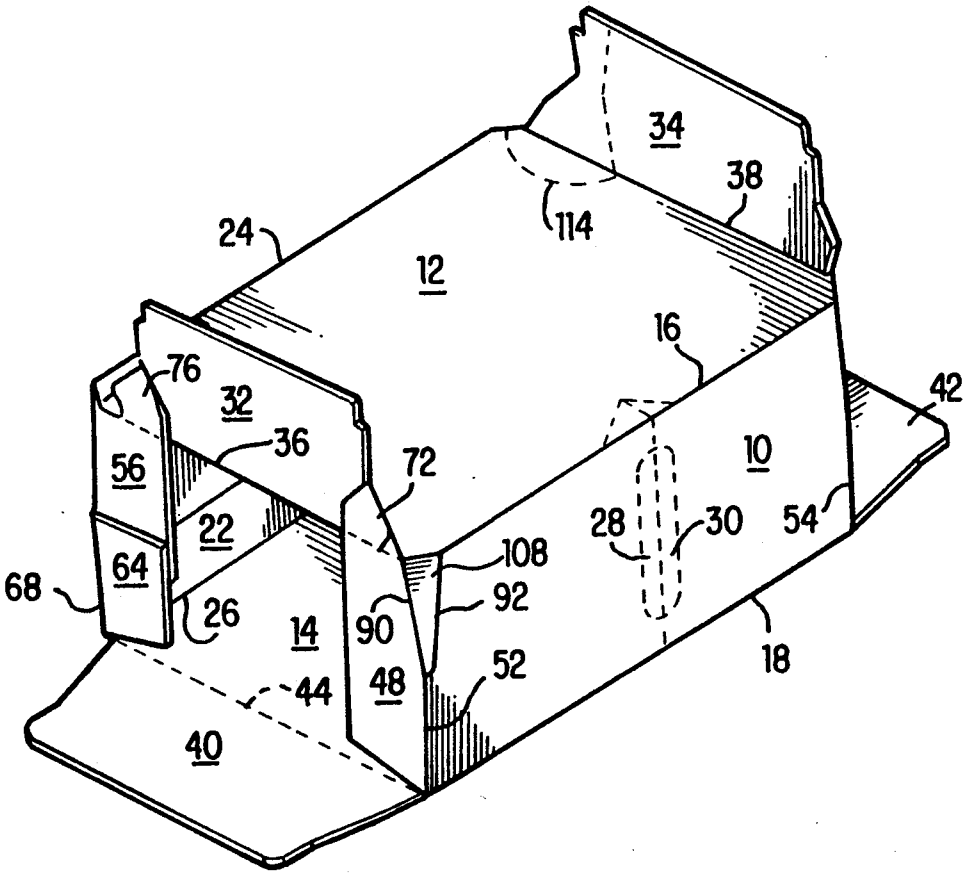
FIG. 6 is a perspective view of the carton in the form wherein one of the major end flaps at each end of the carton is folded into a vertical position.

After the articles are loaded into the carton through the open end or ends of the carton, the major end flaps 32 and 34 are folded upward along the fold lines 36 and 38 to the respective vertical positions as shown in FIG. 6. This action causes the minor end flaps 48 and 50 and the partial end flaps 56, 59, 64 and 66 to swing inwardly together with each triangular corner panel 108 into the respective positions as shown in FIG. 6. By this means, the minor end flaps and the partial minor end flaps are held in place without the necessity of machine elements to prevent them from moving out of the position. Although the minor end flaps 48 and 50 and the partial minor end flaps 56, 58, 64 and 66 form angular junctions at the branch fold lines 90, 92, 94, 96, 98, 100, 104 and 106, their dispositions and the bevelled disposition of each corner panel 108 are dictated by the single fold line portions of the fold lines 52, 54, 60, 62, 68 and 70.

Figure 7:
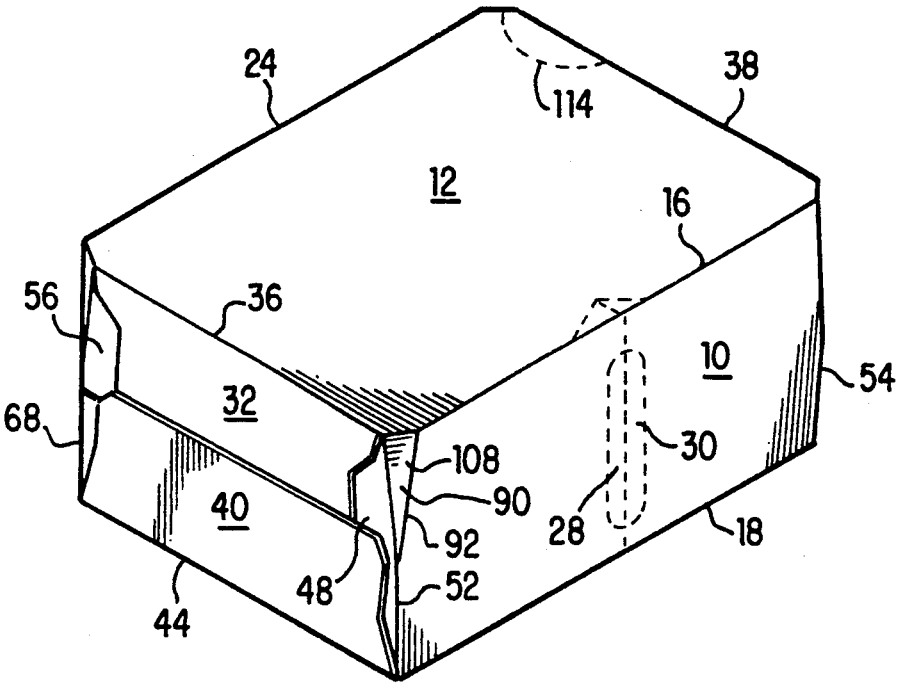
FIG. 7 is a perspective view of the carton in the completed form.

To finalize the formation of the carton, the major end flaps 32 and 34 are folded downwardly through an angle of approximately 180 degrees along fold lines 36 and 38 respectively. Then an application of glue is made to the lower portions of the major end flaps 32 and 34 and, following this, the major end flaps 40 and 42 are elevated along the fold lines 44 and 46 to secure the major end flaps 40 and 42 respectively to the major end flaps 32 and 34. The carton then appears as shown in FIG. 7.

It should be recognized that as used herein, the terms "top", "bottom" and "side" with respect to the various carton walls are relative terms, and that the carton and/or its contents may be re-oriented as necessary or as desired. Further, rather than the bottom wall being formed from separate lap panels 20 and 22, it will be recognized that the carton blank may be rearranged whereby some other panel is formed as a composite from lap panels.

An advantage of this invention, in the completed carton, is that the end walls of the carton have enlarged flat surfaces due to the absence of the bevelled corner panels from the corners of the side wall 14 and that the carton still maintains adequate integrity due to the triangular corner panels at the bevelled corners of the side wall 12. The enlarged flat surfaces are useful as space for carrying printing such as an advertisement, trademark, and other information. Another advantage of the invention is that the degree of smoothness of the end walls is increased since the web panels are eliminated from between the major end flap 40 and the minor end flaps 48 and 64 and from between the major end flap 42 and the minor end flaps 50 and 66.

Having described the invention in detail and by reference to the preferred embodiment thereof, it will be apparent that modification and variation are possible without departing from the scope of the invention defined in the appended claims.

What is claimed is:

1. A carton comprising top and bottom walls connected together by first and second spaced side walls thereby forming a tubular structure having a longitudinal axis and end closure means disposed at an end of said tubular structure to close said end, said end closure means comprising:

a minor end flap foldably joined to one of said top and bottom walls and disposed generally perpendicularly to the axis of said tubular structure;

a major end flap foldably joined to said first side wall and disposed in overlapping relationship with said minor end flap; and a web panel foldably interconnecting said major and minor end flaps, said web panel being tucked in between said major and minor end flaps, a corner of said first side wall defined between said one wall and said major end flap being bevelled and being severed from adjacent portions of said carton, a junction between said one wall and said minor end flap comprising a single fold line extending from said second side wall toward said first side wall, said single fold line bifurcating into two branch fold lines at an intermediate point between said first and second side walls, said branch fold lines extending from said intermediate point to said bevelled corner of said first side wall so as to define a triangular corner panel foldably joined to said one wall and to said minor end flap.

2. The carton according to claim 1, wherein said corner panel defines an obtuse angle with respect to said one wall and to said minor end flap.

3. The carton according to claim 1, wherein a corner of said triangular corner panel defined between said branch fold lines is rounded to lengthen the distance between said intermediate point and said second side wall.

4. The carton according to claim 1, wherein said end closure means further comprising: a second minor end flap foldably joined to the other of said top and bottom walls and disposed generally perpendicularly to the axis of said tubular structure; a second major end flap foldably joined to said second side wall and disposed in overlapping relationship with said first major end flap; and a second web panel foldably interconnecting said second minor end flap with said first major end flap, said second web panel being tucked in between said first major end flap and said second minor end flap, a corner of said first side wall defined between said other wall and said first major end flap being bevelled and being severed from adjacent portions of said carton, a junction between said other wall and said second minor end flap comprising a single fold line extending from said second side wall toward said first side wall and bifurcating into two branch fold lines extending to said bevelled corner between said other wall and said first major end flap.

5. A carton blank comprising:

a first wall;

a second wall foldably joined to a side edge of said first wall;

a major end flap foldably joined to an end of said first wall;

a minor end flap foldably joined to an end of said second wall adjacent to said major end flap; and a web panel foldably interconnecting said major and minor end flaps, a corner of said first wall defined between said second wall and said major end flap being bevelled and being severed by an aperture from adjacent portions of said blank, a junction between said minor end flap and said second wall comprising a single fold line extending from a side edge of said second wall remote from said first wall toward said aperture, said single fold line bifurcating into two branch fold lines at an intermediate point between said aperture and said side edge of said second wall, said branch fold lines extending from said intermediate point to said aperture so as to define a triangular corner panel foldably joined to said second wall and to said minor end flap.

* * * * *